US012203327B2

(12) United States Patent
Hammer et al.

(10) Patent No.: US 12,203,327 B2
(45) **Date of Patent: *Jan. 21, 2025**

(54) CONTROL LINE CLAMP CONFIGURATION, METHOD AND SYSTEM

(71) Applicant: Baker Hughes Oilfield Operations LLC, Houston, TX (US)

(72) Inventors: Aaron C. Hammer, Houston, TX (US); John Wakefield, Cypress, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/940,543

(22) Filed: Sep. 8, 2022

(65) Prior Publication Data

US 2024/0084647 A1 Mar. 14, 2024

(51) Int. Cl.

| | |
|---|---|
| ***E21B 17/02*** | (2006.01) |
| ***E21B 23/04*** | (2006.01) |
| ***E21B 23/14*** | (2006.01) |

(52) U.S. Cl.

CPC ..... *E21B 17/026* (2013.01); *E21B 23/0411* (2020.05); *E21B 23/14* (2013.01)

(58) Field of Classification Search

CPC ..... E21B 17/026; E21B 23/0411; E21B 23/14
See application file for complete search history.

(56) References Cited

U.S. PATENT DOCUMENTS

| | | | |
|---|---|---|---|
| 4,202,087 | A | 5/1980 | Wilderman |
| 4,266,578 | A | 5/1981 | Swain et al. |

(Continued)

FOREIGN PATENT DOCUMENTS

| | | | |
|---|---|---|---|
| CN | 113710871 | A | 11/2021 |
| WO | 2008119501 | A1 | 10/2008 |

(Continued)

OTHER PUBLICATIONS

Notification of Transmittal of the International Search Report and the Written Opinion of the International Searching Authority, or the Declaration; PCT/US2023/073637; Mail date: Jan. 4, 2024; 10 pages.

(Continued)

*Primary Examiner* — D. Andrews
(74) *Attorney, Agent, or Firm* — CANTOR COLBURN LLP

(57) ABSTRACT

A line clamp configuration including a housing, a body attached to the housing, the body having a line contact surface, and a releaser disposed to separate the body from the housing. A control line clamp configuration including a downhole tool housing, an operable component of the downhole tool movable relative to the tool housing, a depending member on the operable component, a clamp body fastened to the housing by the depending member, a control line being releasable by removing the depending member from the clamp body. A control line clamp configuration including a split ring, a clamp body closing the split ring, and a switch to release the clamp body upon receipt of a signal. A borehole system including a borehole in a subsurface formation, a tool in the borehole, a clamp configuration operably connected to the tool.

5 Claims, 10 Drawing Sheets

(56) References Cited

U.S. PATENT DOCUMENTS

| | | | | |
|---|---|---|---|---|
| 4,337,969 | A | 7/1982 | Escaron et al. | |
| 4,603,578 | A | 8/1986 | Stoltz | |
| 5,311,936 | A | 5/1994 | McNair et al. | |
| 6,173,788 | B1 | 1/2001 | Lembcke et al. | |
| 6,367,845 | B1 | 4/2002 | Otten et al. | |
| 7,431,082 | B2 | 10/2008 | Holt et al. | |
| 7,836,960 | B2 * | 11/2010 | Patel | E21B 17/1035 166/385 |
| 7,997,338 | B2 | 8/2011 | Foster et al. | |
| 8,434,571 | B2 | 5/2013 | Kannan et al. | |
| 11,519,239 | B2 | 12/2022 | Greci et al. | |
| 2003/0168221 | A1 * | 9/2003 | Zachman | E21B 17/1035 166/65.1 |
| 2004/0216872 | A1 | 11/2004 | Foster et al. | |
| 2007/0012436 | A1 | 1/2007 | Freyer et al. | |
| 2007/0199693 | A1 | 8/2007 | Kunz | |
| 2009/0173505 | A1 | 7/2009 | Patel et al. | |
| 2009/0277652 | A1 | 11/2009 | Nutley et al. | |
| 2010/0051271 | A1 | 3/2010 | Gano et al. | |
| 2011/0056702 | A1 | 3/2011 | Sharma et al. | |
| 2012/0024545 | A1 * | 2/2012 | Kuo | E21B 17/026 166/117.6 |
| 2014/0014373 | A1 * | 1/2014 | Richards | E21B 17/1035 166/242.6 |
| 2014/0076540 | A1 | 3/2014 | Kang et al. | |
| 2020/0399991 | A1 | 12/2020 | Duggan et al. | |
| 2021/0123319 | A1 | 4/2021 | Greci et al. | |

FOREIGN PATENT DOCUMENTS

| | | | |
|---|---|---|---|
| WO | 2016065244 | A1 | 4/2016 |
| WO | 2021032796 | A1 | 2/2021 |

OTHER PUBLICATIONS

Notification of Transmittal of the International Search Report and the Written Opinion of the International Searching Authority, or the Declaration; PCT/US2023/073643; Mail date; Dec. 21, 2023; 8 pages.

* cited by examiner

CONTROL LINE CLAMP CONFIGURATION, METHOD AND SYSTEM

BACKGROUND

In the resource recovery and fluid sequestration industries there is often need to install tools that expand in the downhole environment. These can be packers, sand screens, etc. Deployments of such tools are commonplace, but all suffer when a control line is to be run outside of an element of the tool. Control lines are run in this way so that they are near the outside diameter of the tool when fully deployed such as in contact with or near the sand face of an open hole, and/or to allow continuous lines as opposed to cut lines running through equipment and then having splices (that increase time and potentially reduce reliability), for example. The art struggles with such deployments and therefore would well receive alternative constructions and methods for similar deployments.

SUMMARY

An embodiment of a control line clamp configuration including a housing, a body attached to the housing, the body having a line contact surface, and a releaser disposed to separate the body from the housing.

An embodiment of a control line clamp configuration including a downhole tool housing, an operable component of the downhole tool movable relative to the tool housing, a depending member on the operable component, a clamp body fastened to the housing by the depending member, a control line being releasable by removing the depending member from the clamp body.

An embodiment of a control line clamp configuration including a split ring, a clamp body connected to one portion of the split ring and interactive with another portion of the split ring to retain the split ring in a closed position, and a switch operably connected to the clamp body to release the clamp body upon receipt of a signal.

An embodiment of a borehole system including a borehole in a subsurface formation, a tool in the borehole, a clamp configuration operably connected to the tool.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1A:
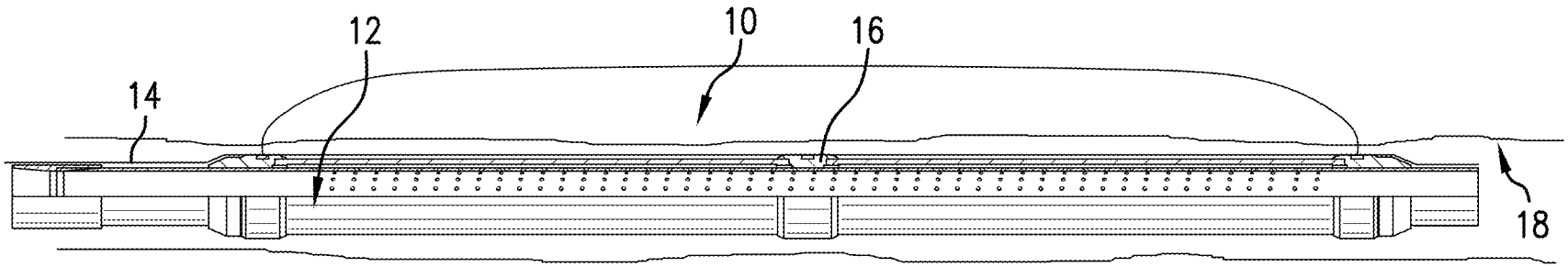
FIG. 1A is a ¾ section view of an expandable tool in a running condition.
Figure 1B:
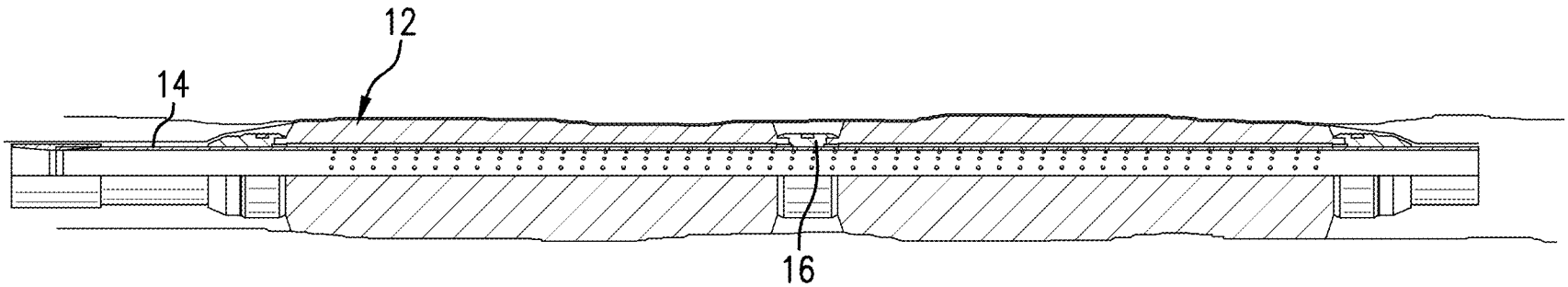
FIG. 1B is the tool of FIG. 1A in a deployed condition.

Referring to FIGS. 1A and 1B, a basic view of a tool 10 of the type disclosed herein is illustrated. The tool 10 includes an expandable component 12 that may be a packer element or a filtration element, for example. The element 12 is expandable in its radial dimension due to being formed of a shape memory polymer, a swellable material, a rubber material, deformable metal, etc. Also illustrated is a control line 14, that may be an electric line, an optic fiber line, a hydraulic line, combinations including one or more of the foregoing, etc. For example, a hydraulic line might be used for control, chemical injection, etc. while an electrical line might be used for monitoring or control). A fiber optic line might be used for monitoring, distributed temperature sensing or distributed acoustic sensing, for example. The line 14 is retained at one or more control line clamp configurations 16 (disposed at end rings or between elements or within a span of elements) during run in.

The retention of control line 14 changes upon deployment pursuant to configurations disclosed herein. While a line 14 is characteristically robustly retained on tools 10 run in a borehole 18 to prevent damage during running, that very retention can become a problem during deployment. Comparing FIGS. 1A and 1B, one can easily perceive that were the line 14 held fast at clamp(s) 16, it would be loaded quite strongly by the expanding element 12. Generally, control lines have greater tensile strength than elements 12 have internal pressure. Commonly then, the line 14 will win and the element 12 will be damaged. It is also possible in some cases, however, that the line 14 could be bent or in some way degraded that would impact its function. Either condition is deleterious to the functionality of the tool 10 and hence detractive to the borehole system 100 in which the tool 10 is employed. In accordance with the teaching hereof, these drawbacks are avoided using clamps as disclosed herein.

Figure 2:
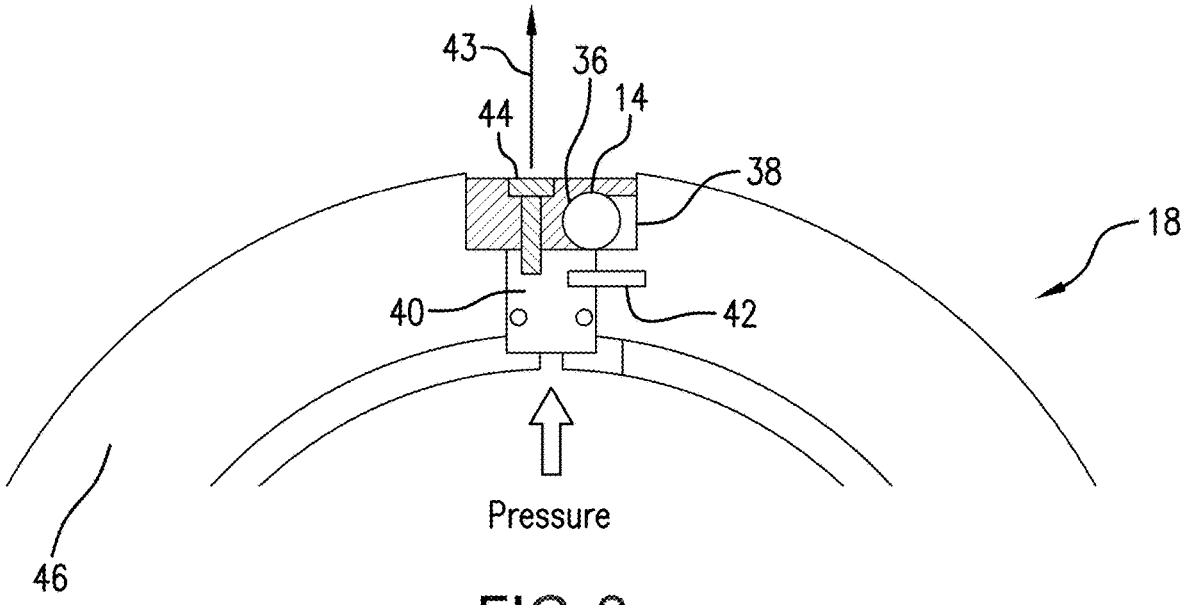
FIG. 2 is a schematic view of a control line clamp configuration using pressure as a release trigger.
Figure 3:
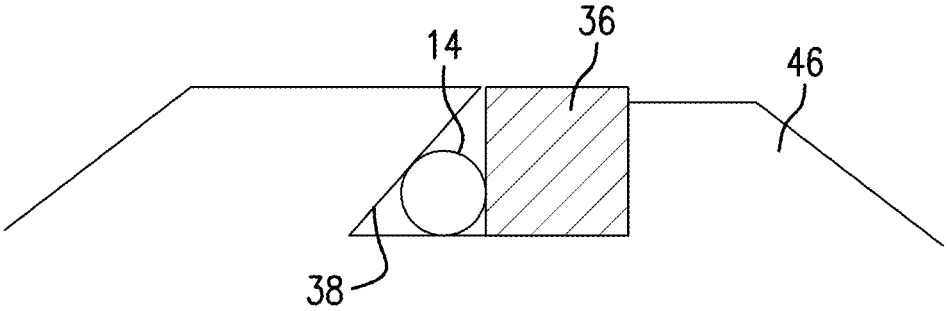
FIG. 3 is an alternate view of clamp construction.

Referring to FIG. 2, a pressure responsive piston-based clamp 16 is illustrated. In this embodiment, a clamp body 36 includes a recess or contact surface 38 to receive or contact at least a portion of a line 14 and secure that line either alone or against another structure of the tool 10. The clamp body 36 is securable to a releaser 40 which in this case is a piston, in one embodiment with a fastener 44, that is initially immobile and upon application of pressure through an inside diameter of the tool 10 can be made movable. The immobility of piston 40 may be by way of a release configuration 42 such as a shear screw or detent or a rupture disk. Regardless of which way, pressure within the inside diameter of the tool 10 causes both the release of the release configuration 42 and the movement of the piston 40. Piston 40 moves radially outward direction of the tool 10 causing the body 36 to move away from a tool housing 46 (in the direction of arrow 43) and thereby opens the recess 38 such that the line 14 may escape from the recess 38. During attachment of the line 14 to the tool 10, the clamp body 36 is placed in position to capture the line 14 and the fastener 44, such as a screw, is used to fasten the clamp body 36 to the piston 40. In embodiments, the clamp body 36 may not actually have the recess 38 formed therein but would be a part of an overall clamp configuration 16 that causes the line 14 to be trapped. For example, referring to FIG. 3, if the housing 46 of the tool 10 formed the recess 38 and the clamp body 36 formed a portion of the wall of that recess 38 that kept the line 14 captured, the same functionality would be achieved with the clamp body 36 moving outwardly and effectively opening the recess 38 of the housing up for the line to escape.

Figure 4:
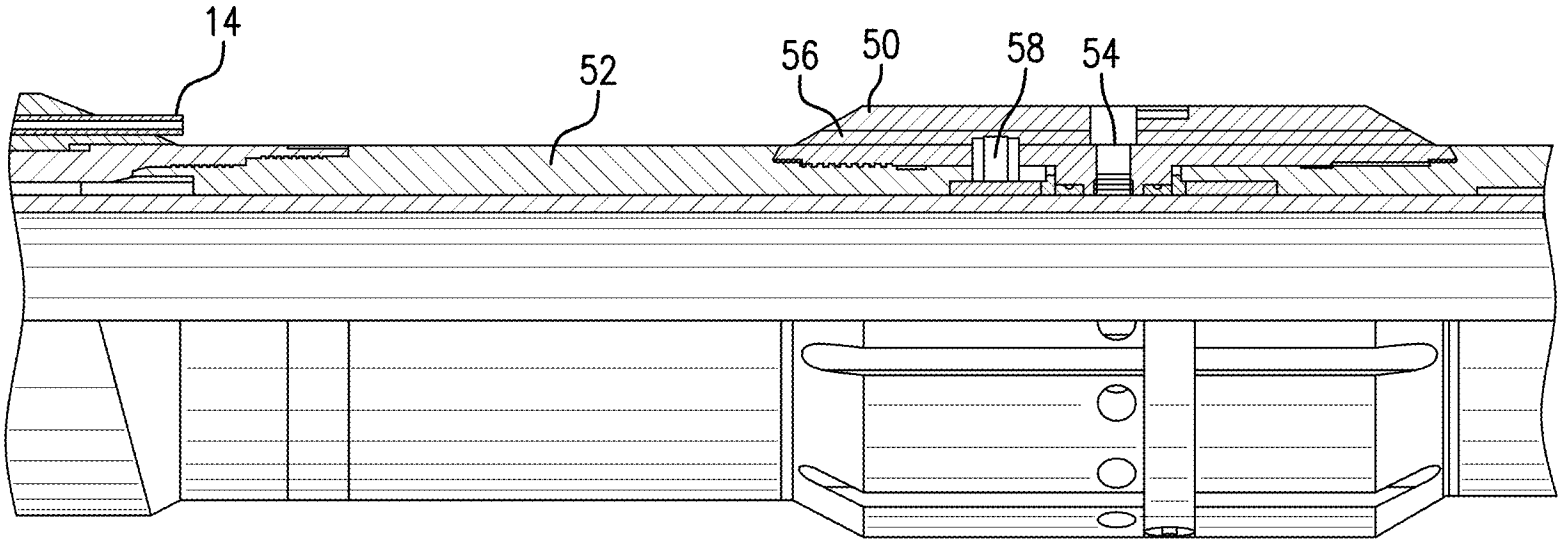
FIGS. 4 and 5 illustrate another embodiment of a control line clamp configuration in a clamps and a released condition respectively.
Figure 5:
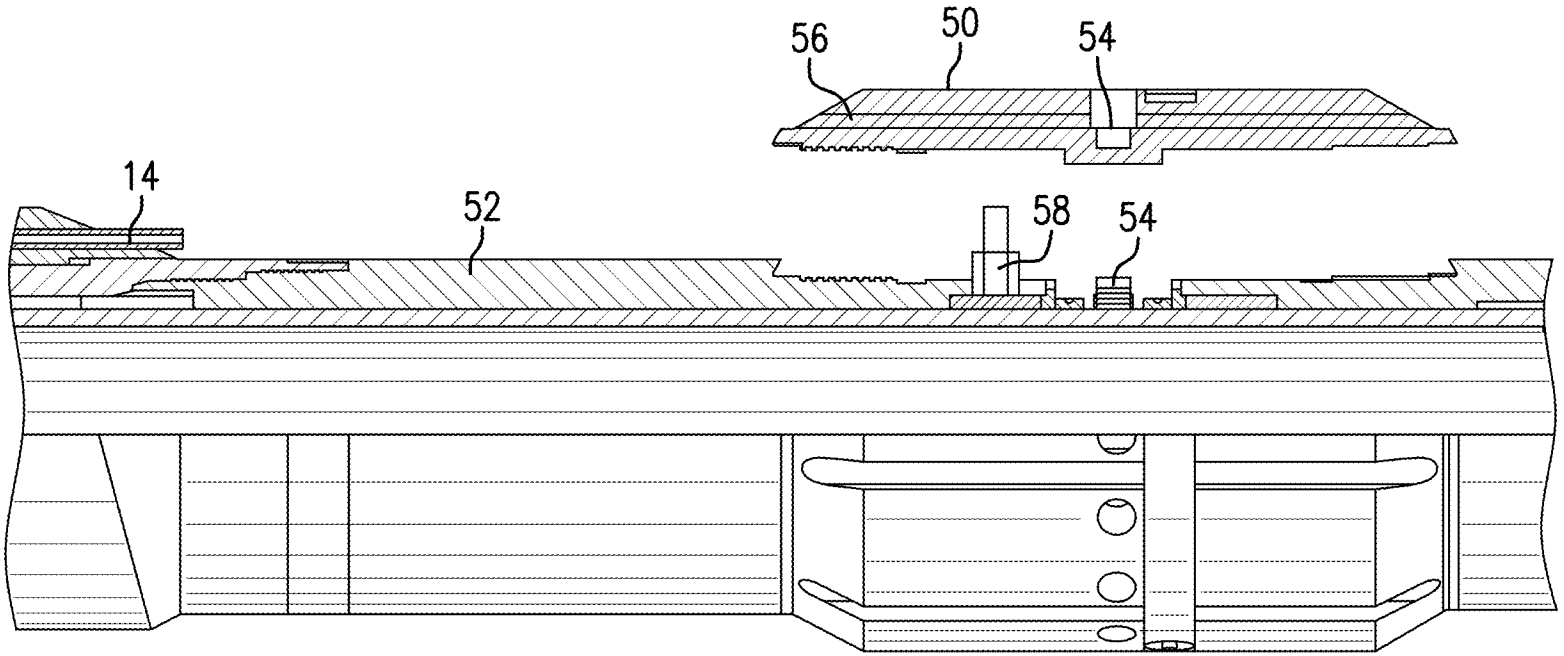

Referring to FIGS. 4 and 5, another embodiment of control line clamp configuration 10 is illustrated in a retained and released condition, respectively. In this embodiment, a clamp body 50 is retained to a tool housing 52 by a release member 54, such as a shear screw or similar. The line 14 is captured in the body in line recess 56 and retained during running. When the tool is to be actuated, the line 14 may be released from retention to the housing 52, though not need to move from recess 56 because clamp body 50 is released from housing 52. More specifically, it will be appreciated that clamp body 50 is fastened to the housing 52 by the release member 54. There is also an actuator 58 (such as a solenoid, linear motor, etc.) located to apply a force to the clamp body 50 tending to separate body 50 from housing 52. electrical energy to actuate this actuator 58 may come from the same line 14 that is being retained and released or from another source. Regardless of source, when a threshold force is applied by the actuator 58 to the clamp body 50, the release member 54 will release and allow clamp body 50 to move away from housing 52. This will remove strain on the line 14 as do embodiments where the line 14 actually escapes the clamp body. The released condition is seen in FIG. 5. The actuator 58 may be signaled from a remote location such as the surface by electrical signal, acoustic signal, and similar.

Figure 6:
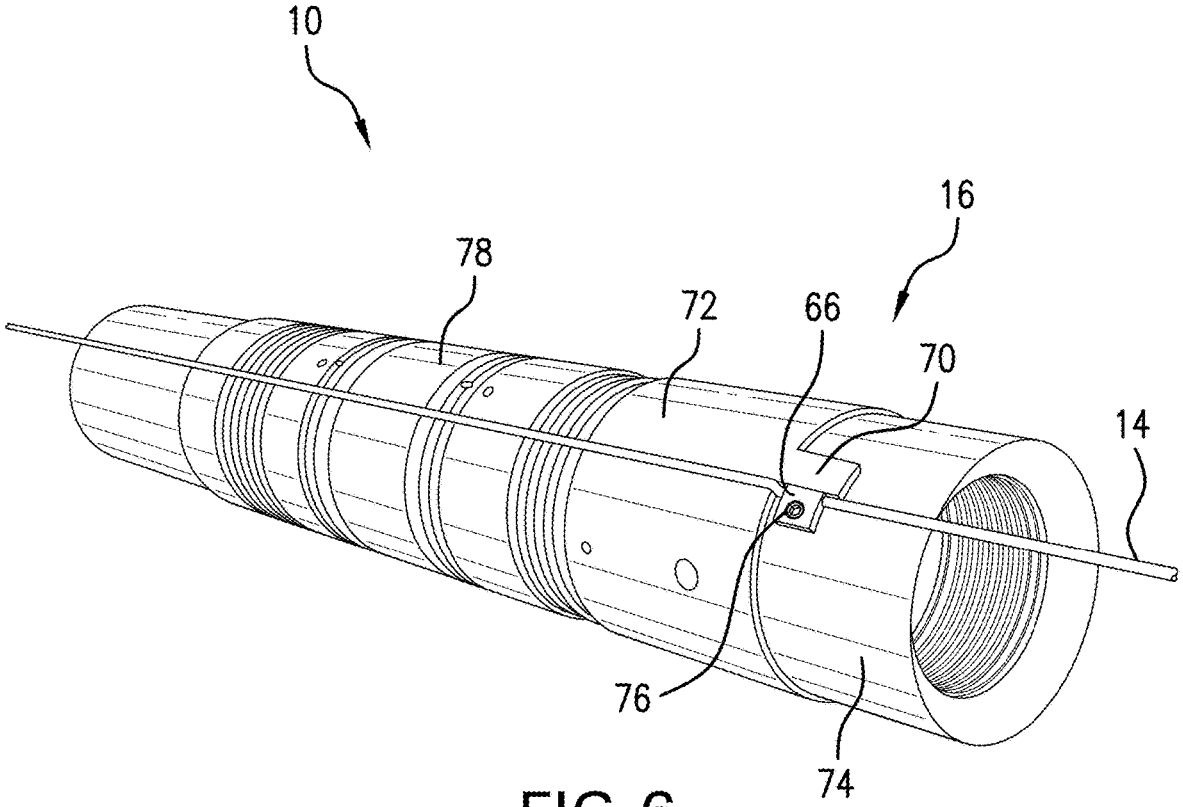
FIG. 6 is a perspective view of a control line clamp configuration using a tab acting to retain the line.
Figure 7:
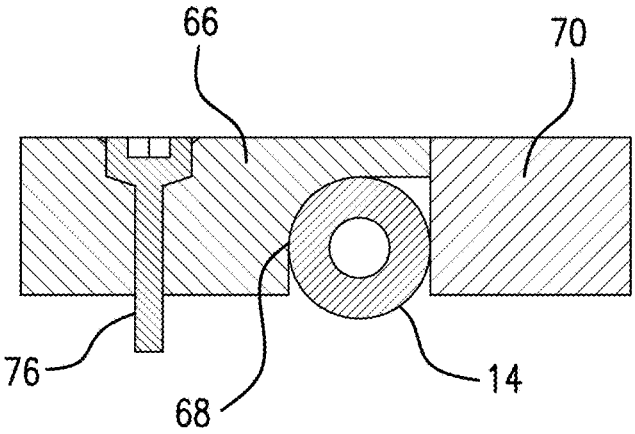
FIG. 7 is a section view of the clamp configuration in FIG. 6.

Referring to FIGS. 6 and 7 another alternate embodiment of a control line clamp configuration 16 is illustrated. In this embodiment, a clamp body 66 includes a recess 68 receptive of a line 14, which recess 68 is open laterally and cooperative with a depending member 70 which may be a tab, or pin, or other structure movable with an operable component 72, such as for example a packer setting piston. The tab 70 is placed in contact with the body 66 or spaced therefrom up to a distance less than a diameter of the control line 14. The clamp 66 may be secured to a housing 74 of tool 10 by a fastener 76 or may be a part of housing 74, in embodiments. As will be appreciated, when the packer setting piston is actuated, it moves longitudinally of the tool 10 toward the packer element 78, compressing the same. As this movement proceeds, the depending member 70 moves away from the clamp body 66 and hence allows the line 14 to escape the clamp configuration 16.

Figure 8:
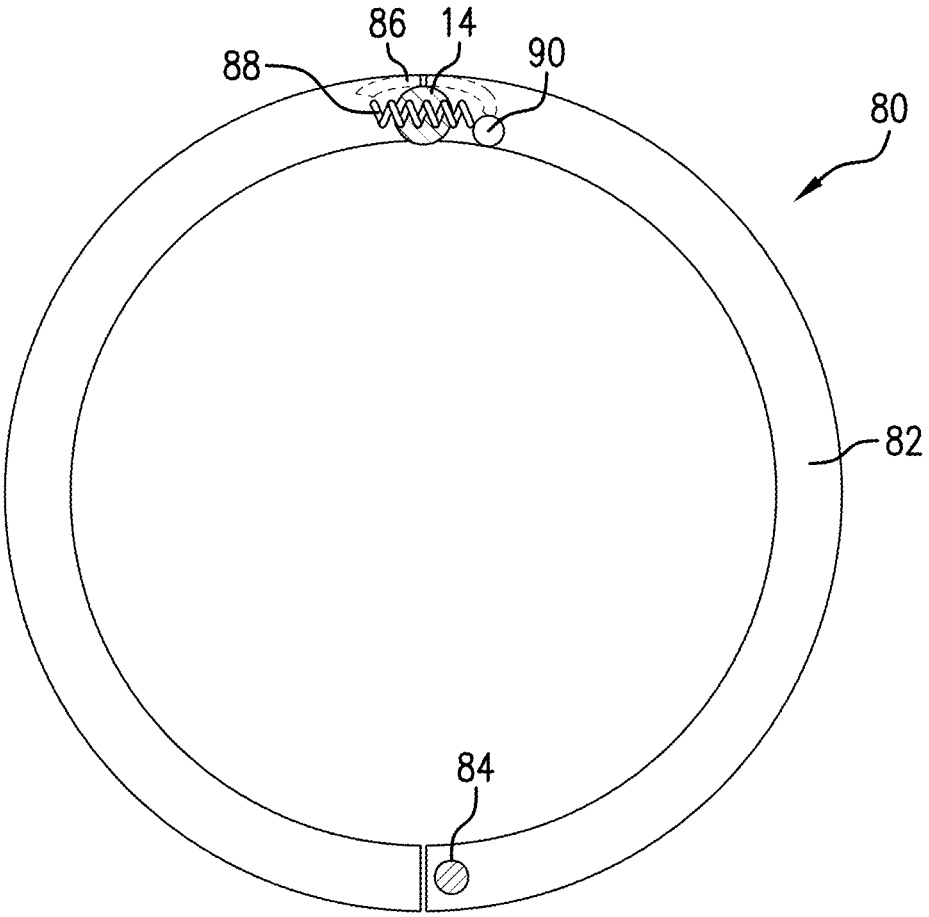
FIGS. 8 and 9 are two positions of an alternate embodiment of control line clamp configuration.
Figure 9:
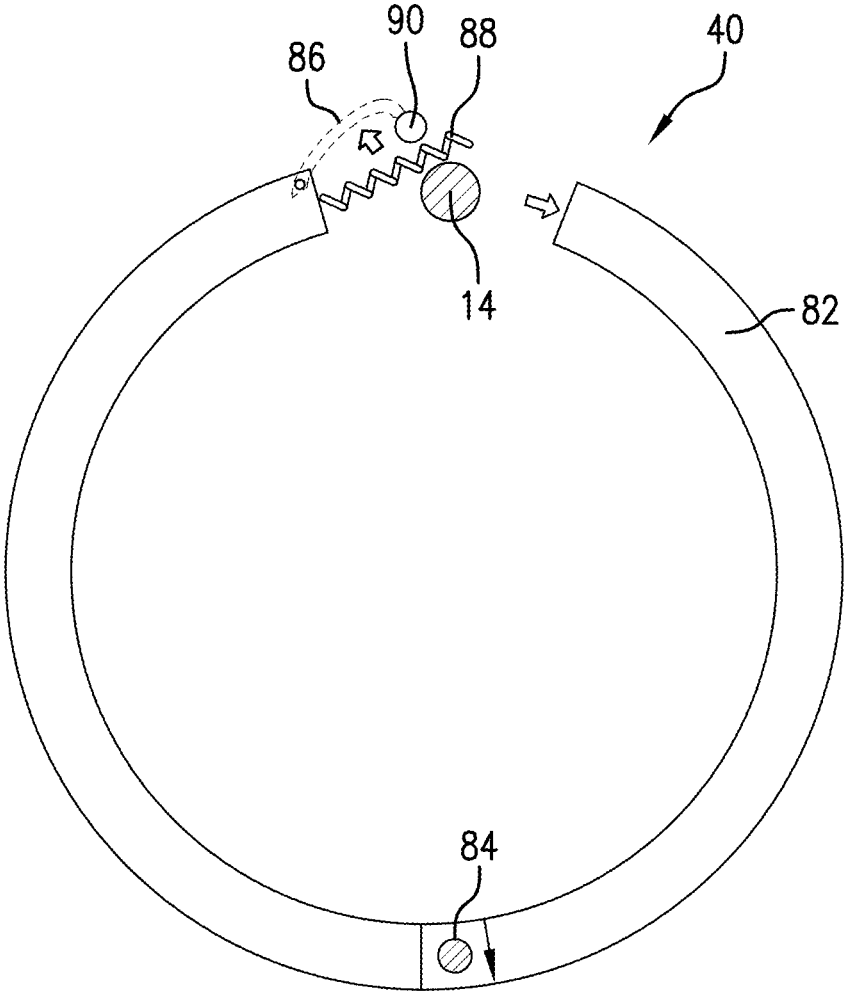

Referring to FIGS. 8 and 9, an alternate embodiment of control line claim configuration 80 is illustrated in a line retained position and a line released position, respectively. The configuration 80 employs a split ring 82 that may comprise a single piece ring having a split therein or could comprise a multipiece ring having one of more hinge pins. As illustrated, there is one hinge pin 84 opposite a clamp body 86. Clamp body 86 retains the split ring 82 in a closed position and traps the line 14 radially inwardly of the clamp body 86. A spring 88 is maintained in a compressed condition when the configuration 80 is in the line retained position, in some embodiments. A switch 90, that may be electrical or may respond to the other inputs discussed hereinabove, is addressable to trigger the clamp body 86 to release. Once the clamp body 86 releases, the configuration moves to the position illustrated in FIG. 9 wherein the line 14 is released.

Figure 10:
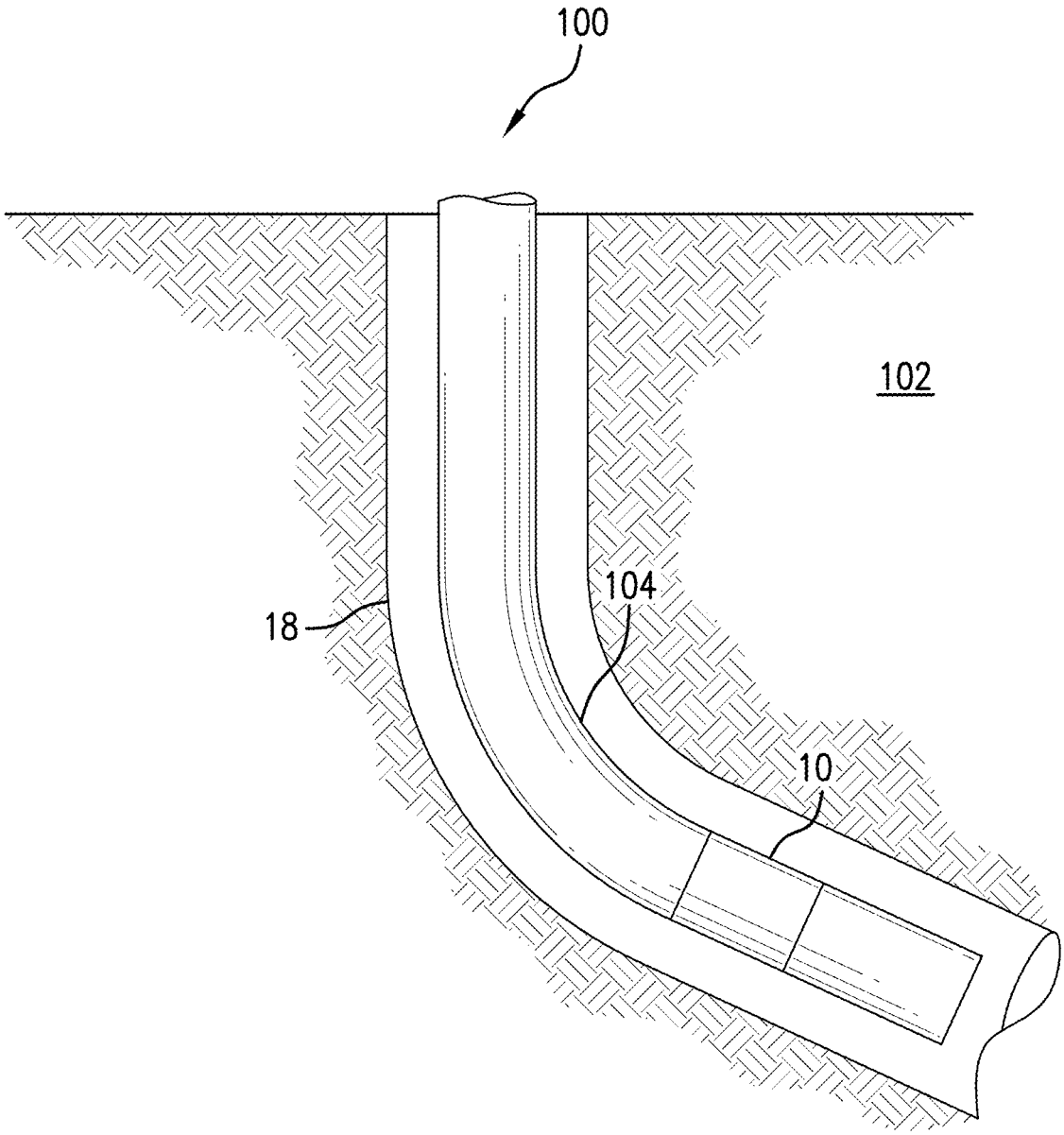
FIG. 10 is a view of a borehole system including a control line clamp configuration as disclosed herein.

Referring to FIG. 10, a borehole system 100 is illustrated. The system 100 comprises a borehole 18 in a subsurface formation 102. A string 104 is disposed within the borehole 18. A control line clamp configuration 10 is disposed within or as a part of the string 104 disclosed herein.

Set forth below are some embodiments of the foregoing disclosure:

Embodiment 1: A control line clamp configuration including a housing, a body attached to the housing, the body having a line contact surface, and a releaser disposed to separate the body from the housing.

Embodiment 2: The configuration as in any prior embodiment wherein the releaser is responsive to a pressure event.

Embodiment 3: The configuration as in any prior embodiment wherein the releaser is a piston.

Embodiment 4: The configuration as in any prior embodiment further comprising a release member initially securing the releaser.

Embodiment 5: The configuration as in any prior embodiment wherein the release member is a shear screw.

Embodiment 6: A control line clamp configuration including a downhole tool housing, an operable component of the downhole tool movable relative to the tool housing, a depending member on the operable component, a clamp body fastened to the housing by the depending member, a control line being releasable by removing the depending member from the clamp body.

Embodiment 7: The configuration as in any prior embodiment wherein during operation of the operable component, the depending member moves away from the clamp body releasing the control line.

Embodiment 8: The configuration as in any prior embodiment wherein the depending member moves longitudinally of the tool housing.

Embodiment 9: The configuration as in any prior embodiment wherein the operable component is a sleeve.

Embodiment 10: The configuration as in any prior embodiment wherein the sleeve is an element setting sleeve.

Embodiment 11: A control line clamp configuration including a split ring, a clamp body connected to one portion of the split ring and interactive with another portion of the split ring to retain the split ring in a closed position, and a switch operably connected to the clamp body to release the clamp body upon receipt of a signal.

Embodiment 12: The configuration as in any prior embodiment wherein the switch is responsive to an electrical signal.

Embodiment 13: A borehole system including a borehole in a subsurface formation, a tool in the borehole, a clamp configuration as in any prior embodiment operably connected to the tool.

Embodiment 14: A borehole system including a borehole in a subsurface formation, a tool in the borehole, a clamp configuration as in any prior embodiment operably connected to the tool.

Embodiment 15: A borehole system including a borehole in a subsurface formation, a tool in the borehole, a clamp configuration as in any prior embodiment operably connected to the tool.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A control line clamp configuration comprising:

a downhole tool housing;

an operable component of the downhole tool movable relative to the tool housing;

a depending member on the operable component and movable with the component relative to the tool housing during setting of a packer connected to the tool housing;

a clamp body fastened to the housing adjacent the depending member in a range of distance from the depending member of from in contact with the depending member to a distance less than a diameter of a control line to be secured between the depending member and the clamp body during use, the control line being releasable by moving the depending member relative to the clamp body a distance that allows release of the control line.

2. The configuration as claimed in claim 1 wherein the depending member moves longitudinally of the tool housing.

3. The configuration as claimed in claim 1 wherein the operable component is a sleeve.

4. The configuration as claimed in claim 3 wherein the sleeve is an element setting sleeve.

5. A borehole system comprising:

a borehole in a subsurface formation;

a tool in the borehole;

a clamp configuration as claimed in claim 1 operably connected to the tool.

* * * * *